US009813803B1

(12) United States Patent
Lin

(10) Patent No.: US 9,813,803 B1
(45) Date of Patent: Nov. 7, 2017

(54) ELECTRICAL SPEAKER ASSEMBLY

(71) Applicant: Wu-Hsu Lin, Taichung (TW)

(72) Inventor: Wu-Hsu Lin, Taichung (TW)

( * ) Notice: Subject to any disclaimer, the term of this patent is extended or adjusted under 35 U.S.C. 154(b) by 0 days.

(21) Appl. No.: 15/145,974

(22) Filed: May 4, 2016

(51) Int. Cl.
*H04R 1/28* (2006.01)
*H04R 1/24* (2006.01)

(52) U.S. Cl.
CPC ..... *H04R 1/2811* (2013.01); *H04R 1/24* (2013.01); *H04R 2201/029* (2013.01)

(58) Field of Classification Search
CPC ..... G01S 7/521; H02J 7/0044; H04R 1/025; H04R 1/028; H04R 1/2811; H04R 29/001; H04R 9/041; G10K 11/002
USPC ..... 367/162; 381/74, 373, 379, 380, 381, 381/384, 385, 59, 86, 122, 160, 162, 332, 381/334, 335, 336, 351, 386, 387, 389, 381/395, 397, 400, 407, 409, 412; 455/557; 181/148, 150, 160; 227/8; 343/702
See application file for complete search history.

(56) References Cited

U.S. PATENT DOCUMENTS 4,616,731 A * 10/1986 Robinson ..... H04R 1/2857 181/148
6,088,466 A * 7/2000 Proni ..... H04R 9/02 381/397
6,373,955 B1 * 4/2002 Hooley ..... H03K 7/08 381/332
6,374,942 B1 * 4/2002 Huggins ..... H04R 1/025 181/150
9,497,547 B2 * 11/2016 Chen ..... H04R 9/041
9,615,155 B2 * 4/2017 Yoshida ..... H04R 1/025
9,620,972 B2 * 4/2017 Oh ..... H02J 7/0044
9,641,924 B2 * 5/2017 Moon ..... H04R 1/028
2003/0059080 A1 * 3/2003 Backman ..... H04R 7/04 381/407
2007/0154021 A1 * 7/2007 Bohman ..... H03F 1/32 381/59
2008/0025547 A1 * 1/2008 Yun ..... H04M 1/035 381/389
2010/0104116 A1 * 4/2010 Liou ..... H04R 19/013 381/191
2010/0322456 A1 * 12/2010 Park ..... H04M 1/035 381/387
2011/0122731 A1 * 5/2011 Buccafusca ..... G10K 9/122 367/162
2012/0207321 A1 * 8/2012 Oshima ..... H04R 9/045 381/86
2012/0257784 A1 * 10/2012 Tang ..... H04R 9/046 381/409
2013/0329929 A1 * 12/2013 Yoshida ..... H04R 1/02 381/334
2014/0029783 A1 * 1/2014 Yang ..... H04R 1/02 381/395
2014/0119576 A1 * 5/2014 Ando ..... H04R 17/005 381/162

(Continued)

*Primary Examiner* — Gerald Gauthier
(74) *Attorney, Agent, or Firm* — Birch, Stewart, Kolasch & Birch, LLP

(57) ABSTRACT

An electrical speaker assembly has a speaker element and two caps. The speaker element has two sides. The caps are attached respectively to the two sides of the speaker element, and each cap has a resonance space between the cap and a corresponding one of the sides of the speaker element, wherein one of the caps has a wire notch defined in the cap.

2 Claims, 7 Drawing Sheets

(56) References Cited

U.S. PATENT DOCUMENTS

| | | | | |
|---|---|---|---|---|
| 2014/0294225 | A1* | 10/2014 | Ji | H04R 1/021 381/386 |
| 2014/0301587 | A1* | 10/2014 | Ji | H04R 1/025 381/332 |
| 2014/0369533 | A1* | 12/2014 | Kim | H04R 1/345 381/160 |
| 2015/0016658 | A1* | 1/2015 | Lee | H04R 9/045 381/412 |
| 2015/0055818 | A1* | 2/2015 | Chen | H04R 9/041 381/400 |
| 2015/0281817 | A1* | 10/2015 | Crose | G09B 5/04 381/122 |
| 2016/0136797 | A1* | 5/2016 | Weigmann | B25C 1/04 227/8 |
| 2016/0192046 | A1* | 6/2016 | Pietschmann | H04R 1/026 381/336 |
| 2016/0240181 | A1* | 8/2016 | McNutt | G10K 11/002 |
| 2016/0345113 | A1* | 11/2016 | Lee | G01S 15/04 |
| 2017/0090021 | A1* | 3/2017 | Sayer | G01S 7/521 |

* cited by examiner

ELECTRICAL SPEAKER ASSEMBLY

BACKGROUND OF THE INVENTION

1. Field of the Invention

The present invention relates to a speaker assembly, and more particularly to an electrical speaker assembly that can increase the sound frequency and generate clear sounds.

2. Description of Related Art

With reference to FIG. 7, a conventional electrical speaker 90 comprises a copper plate 92 and a ceramic plate 91 attached to one side of the copper plate 92. When electric currents are led respectively into the copper plate 92 and the ceramic plate 91, the electrical speaker 90 can generate sounds because of different resonance frequencies of the materials of the plates 91,92.

However, the sound generated by the conventional electrical speaker 90 is in a low frequency, in a low voice, and is unclear, so the sound generated by the conventional electrical speaker 90 cannot be applied to seek objects or for identification and is not versatile in use.

To overcome the shortcomings, the present invention tends to provide an electrical speaker assembly to mitigate or obviate the aforementioned problems.

SUMMARY OF THE INVENTION

The main objective of the invention is to provide an electrical speaker assembly that can increase the sound frequency and generate clear sounds. The electrical speaker assembly has a speaker element and two caps. The speaker element has two sides. The two caps are attached respectively to the two sides of the speaker element, and each cap has a resonance space between the cap and a corresponding one of the sides of the speaker element, wherein one of the caps has a wire notch defined in the cap.

Other objects, advantages and novel features of the invention will become more apparent from the following detailed description when taken in conjunction with the accompanying drawings.

DETAILED DESCRIPTION OF PREFERRED EMBODIMENT

Figure 1:
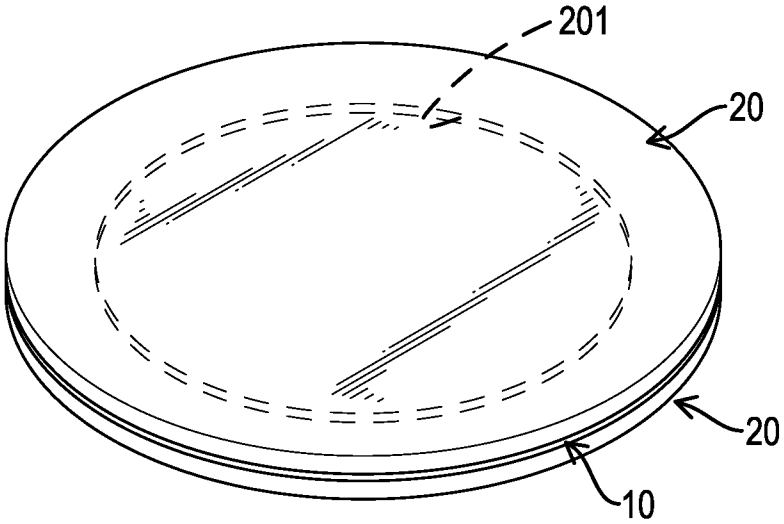
FIG. 1 is a perspective view of a first embodiment of an electrical speaker assembly in accordance with the present invention.
Figure 2:
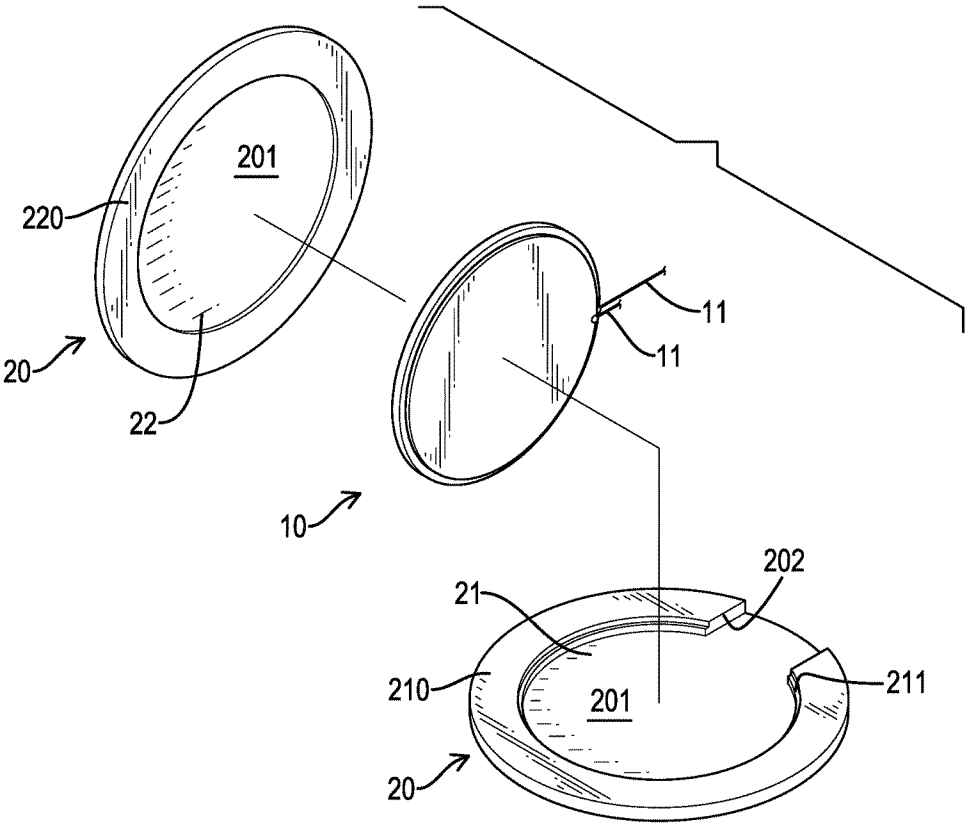
FIG. 2 is an exploded perspective view of the electrical speaker assembly in FIG. 1.
Figure 3:
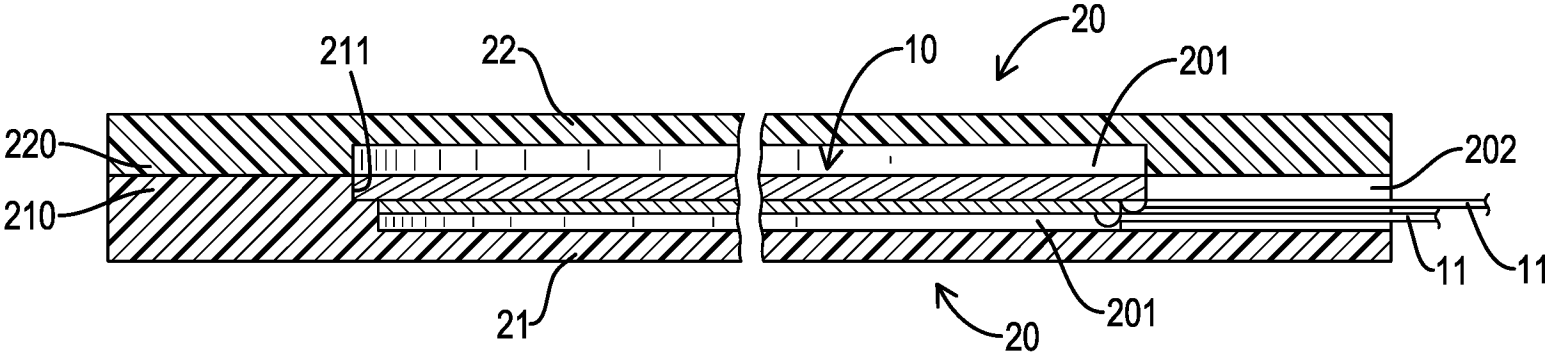
FIG. 3 is an enlarged side view in partial section of the electrical speaker assembly in FIG. 1.

With reference to FIGS. 1 to 3, a first embodiment of an electrical speaker assembly in accordance with the present invention comprises a speaker element 10 and two caps 20. The speaker element 10 may be an electrical speaker that comprises a copper plate and a ceramic plate. When electric currents are led to the copper and ceramic plates, sound will be generated due to the different resonance frequencies of the plates. The two caps 20 are attached respectively to the two sides of the speaker element 10, and each cap 20 has a resonance space 201 between the cap 20 and a corresponding one of the sides of the speaker element 10. One of the caps 20 has a wire notch 202 defined in the cap 20.

Preferably, the two caps 20 include a first cap 21 and a second cap 22. The first cap 21 has a first abutting flange 210 and a holding recess 211. The first abutting flange 210 is annular, is formed on the first cap 21 at a side facing the speaker element 10, and has an inner surface. The holding recess 211 is defined in the inner surface of the first abutting flange 210 to hold the speaker element 10 inside the holding recess 211. The second cap 22 has a second abutting flange 220. The second abutting flange 220 is annular, is formed on the second cap 22 at a side facing the speaker element 10, and abuts the first abutting flange 210.

In addition, the wire notch 202 is defined through the first abutting flange 210 of the first cap 21. Alternatively, the wire notch 202 may be defined through the second abutting flange 220 of the second cap 22.

Figure 4:
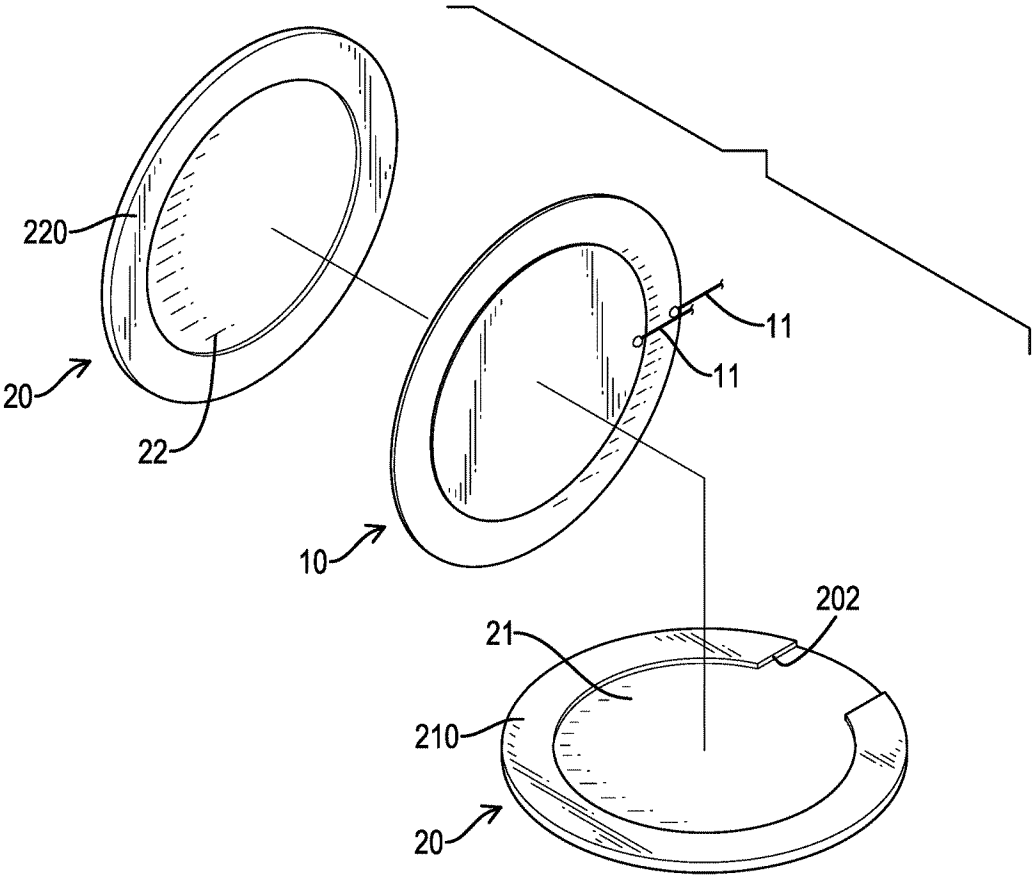
FIG. 4 is an exploded perspective view of a second embodiment of an electrical speaker assembly in accordance with the present invention.
Figure 5:
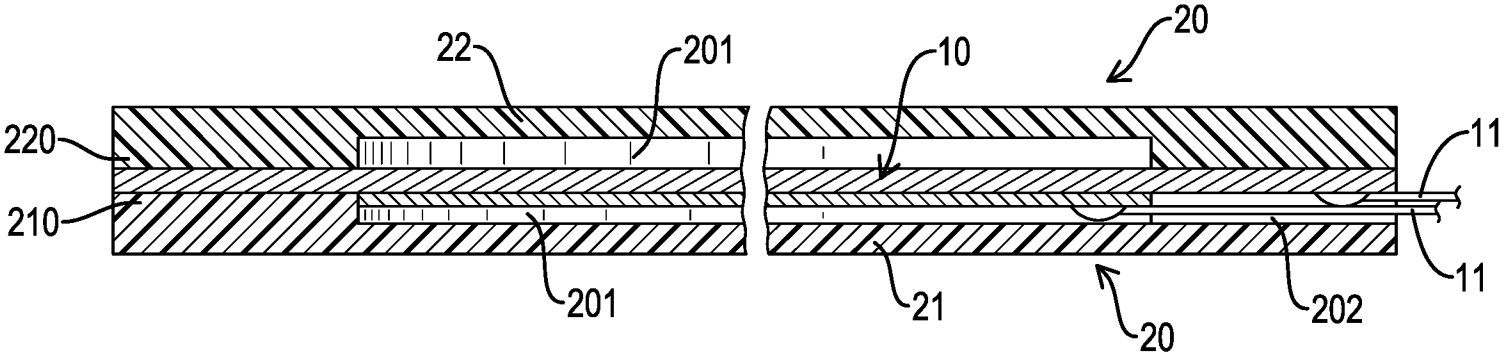
FIG. 5 is an enlarged side view in partial section of the electrical speaker assembly in FIG. 4.

With reference to FIGS. 4 and 5, in the second embodiment of the electric speaker assembly in accordance with the present invention, the two caps 20 include a first cap 21 and a second cap 22. The first cap 21 has an annular first abutting flange 210 formed on the first cap 21 at a side facing the speaker element 10. The second cap 22 has an annular second abutting flange 220 formed on the second cap 20 at a side facing the speaker element 10. The first abutting flange 210 and the second abutting flange 220 abut respectively on two sides of a periphery of the speaker element 10.

Figure 6:
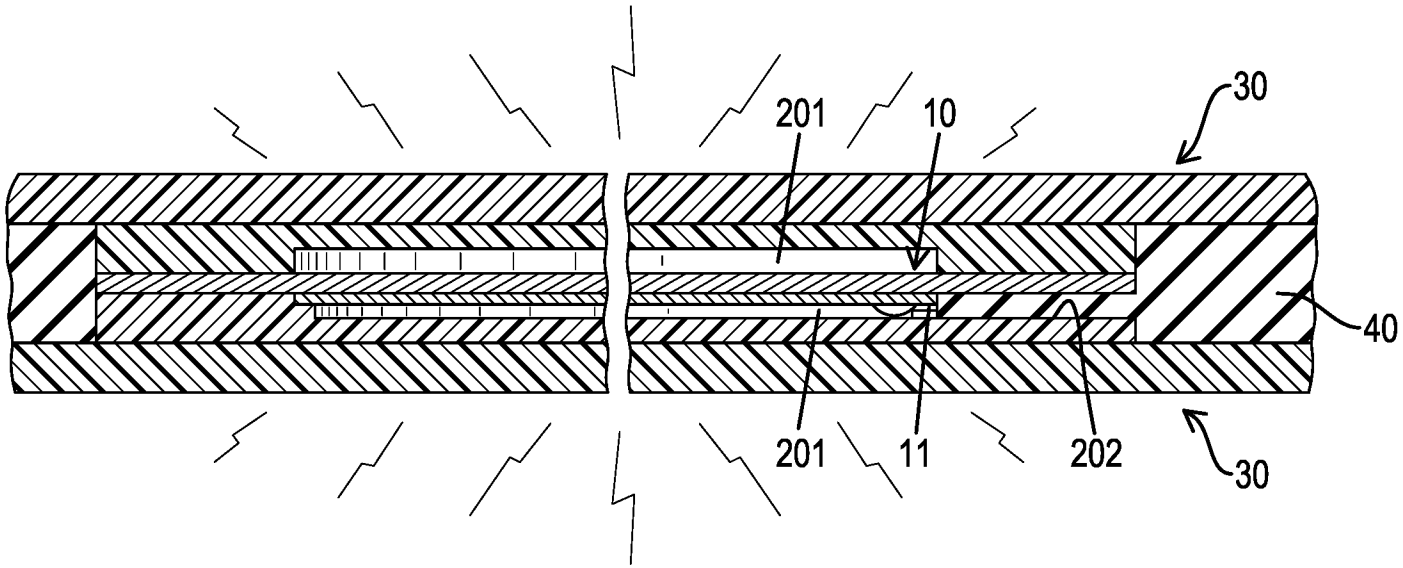
FIG. 6 is an enlarged operational side view in partial section of the electrical speaker assembly in FIG. 1.
Figure 7:
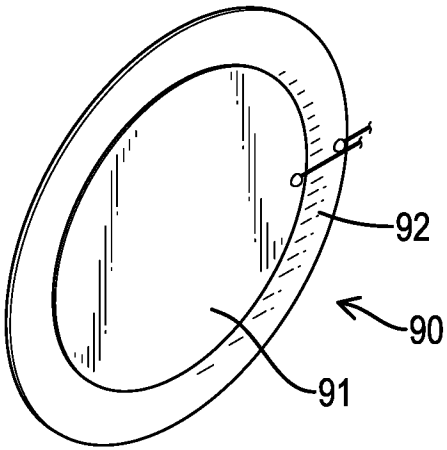
FIG.7 PRIOR ART
FIG. 7 is a perspective view of a conventional electrical speaker.

With reference to FIGS. 3 and 6, in use, the electrical speaker assembly in accordance with the present invention can be mounted in an object 30, such as a vehicle remote controller, an electrical switch or a proximity card. To assemble the electrical speaker assembly with the object 30, electrical wires 11 connected to the speaker element 10 are mounted through to extend out of the wire notch 202, and sealing material 40 is applied to seal the wire notch 202 to seal the resonance spaces 201.

With such an arrangement, two sealed resonance spaces 201 are defined between two sides of the speaker element 10. Therefore, when the speaker element 10 generates sound, the sound waves generated by the speaker element 10 will vibrate back and forth between the resonance spaces 201 to generate resonance. Accordingly, the sound frequency and the sound voice can be increased, the sound is clear, and the electrical speaker assembly can be applied to seek objects or for identification and is versatile in use.

In addition, with the caps 20 arranged on the two sides of the speaker element 10, the sealing material can be kept from attaching to the speaker element 10 during the sealing process. Therefore, the sound quality generated by the speaker element 10 will not be affected.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical speaker assembly comprising:

a speaker element having two sides; and two caps attached respectively to the two sides of the speaker element, and each cap having a resonance space between the cap and a corresponding one of the sides of the speaker element, wherein one of the caps has a wire notch defined in the cap, wherein the two caps include a first cap and a second cap;

the first cap has an annular first abutting flange formed on the first cap at a side facing the speaker element;

the second cap has an annular second abutting flange formed on the second cap at a side facing the speaker element; and the first abutting flange and the second abutting flange abut respectively on two sides of a periphery of the speaker element.

2. An electrical speaker assembly comprising:

a speaker element having two sides; and two caps attached respectively to the two sides of the speaker element, and each cap having a resonance space between the cap and a corresponding one of the sides of the speaker element, wherein one of the caps has a wire notch defined in the cap, wherein the two caps include a first cap and a second cap;

the first cap has an annular first abutting flange formed on the first cap at a side facing the speaker element and having an inner surface; and a holding recess defined in the inner surface of the first abutting flange to hold the speaker element inside the holding recess; and the second cap has an annular second abutting flange formed on the second cap at a side facing the speaker element and abutting the first abutting flange.

* * * * *